US007047733B1

(12) United States Patent
Pecouyoul

(10) Patent No.: US 7,047,733 B1
(45) Date of Patent: May 23, 2006

(54) COMPACT ELECTRO-HYDRAULIC GENERATOR TO MOTORIZE CUPOLA

(75) Inventor: Gabriel Pecouyoul, Longjumeau (FR)

(73) Assignee: Giat Industries, Versailles (FR)

( * ) Notice: Subject to any disclaimer, the term of this patent is extended or adjusted under 35 U.S.C. 154(b) by 156 days.

(21) Appl. No.: 10/777,073

(22) Filed: Feb. 13, 2004

(30) Foreign Application Priority Data

Feb. 18, 2003 (FR) ..... 03 01947

(51) Int. Cl.
*F15B 1/00* (2006.01)

(52) U.S. Cl. ..... 60/325; 60/413

(58) Field of Classification Search ..... 60/413, 60/453, 325; 89/41.12, 41.15, 37.07, 37.09, 89/37.02, 37.17
See application file for complete search history.

(56) References Cited

U.S. PATENT DOCUMENTS

| | | | | |
|---|---|---|---|---|
| 2,528,645 | A | 11/1950 | Edwards | 60/53 |
| 2,893,355 | A * | 7/1959 | Bauer | 60/402 |
| 3,015,254 | A * | 1/1962 | Leathers et al. | 89/41.12 |
| 3,223,000 | A | 12/1965 | Payne et al. | 91/448 |
| 3,357,179 | A * | 12/1967 | Gourlay et al. | 60/463 |
| 3,775,736 | A * | 11/1973 | Koomey | 367/133 |
| 3,907,120 | A * | 9/1975 | Johnston et al. | 60/404 |
| 3,979,909 | A | 9/1976 | Meyer et al. | 60/458 |
| 4,112,687 | A * | 9/1978 | Dixon | 60/641.6 |
| 4,573,397 | A * | 3/1986 | LeBlanc et al. | 89/41.12 |
| 5,104,294 | A | 4/1992 | Banba | 417/36 |
| 5,253,982 | A | 10/1993 | Niemiec et al. | 417/38 |

FOREIGN PATENT DOCUMENTS

| | | |
|---|---|---|
| DE | 42 19 462 A1 | 12/1993 |
| DE | 100 28 957 A1 | 1/2002 |
| EP | 0 694 700 A1 | 1/1996 |
| EP | 0 916 853 A2 | 5/1999 |
| GB | 1 429 795 | 3/1976 |
| JP | 49-89074 | 8/1974 |
| JP | 10-299645 | 11/1998 |
| JP | 2001-227501 A | 8/2001 |
| WO | WO 95/02769 | 1/1995 |
| WO | WO 98/56630 | 12/1998 |

OTHER PUBLICATIONS

"Centrales Hydrauliques: Produits Standards Ou Systems Adaptes ?", Promo Energie Fluides, PPI. Paris, France, No. 3, Apr. 1999, pp. 12-13, XP000830831.

* cited by examiner

*Primary Examiner*—Igor Kershteyn
(74) *Attorney, Agent, or Firm*—Steptoe & Johnson LLP

(57) ABSTRACT

The present invention divulges a particularly compact electro-hydraulic generating set and its application in combination with a compact actuator to pilot the traverse movement of a close cupola head assembly or of one or several offset cupola head assemblies.

The compactness of the electro-hydraulic generating set and the possibility of the close or offset mounting of one or several cupola head assemblies make various architectures possible.

14 Claims, 3 Drawing Sheets

COMPACT ELECTRO-HYDRAULIC GENERATOR TO MOTORIZE CUPOLA

BACKGROUND OF THE INVENTION

The technical scope of the present invention is that of electro-hydraulic generating sets or rotating actuating gear used to rotate the turrets or cupolas, for example of weapon systems.

To date, hydraulic motorisations to drive turrets or cupolas in rotation are known. Such actuating gear have been frequently used in dated equipment or weapon systems and notably in vehicles that had a hydraulic generating set on board, already installed for other functions, for example propulsion. In these cases, the actuating gear amounted to no more than a hydraulic motor, the hydraulic power being supplied by the equipment's central hydraulic generating set.

The current trend is to gradually replace hydraulic generating systems by electric generating systems to supply equipment and notably vehicles. This naturally leads to the use of motorisations to drive the turrets or cupolas, of a type adapted to the power available on the equipment, in other words back-geared motors. These systems are classically built around an electric motor. The mechanical characteristics of such a motor are generally not enough in terms of torque and are oversized in terms of speed. Thus, its output is coupled with reducing gear. This reducing gear is classically a gear-based mechanical system well known to the expert. Such a back-geared electric motor is currently used in the area of driving turrets and cupolas that are installed on either fixed equipment or vehicles.

Such a back-geared electric motor is able to provide substantial power at a sustained rate if it there is an electric supply of sufficient capacity available. The back-geared electric motor has the secondary advantage of being very compact because of the small number of components and the use of compact gears of the planetary gear train, worm wheel or flexible external crown type. A large speed reducing ratio allows, in addition, the necessary volume of the motor to be reduced.

However, the profile of use of a turret or cupola motorisation is very intermittent. The cupola or cupolas remain inactive or on stand-by for long periods and are then individually used periodically but intensively. Furthermore, in the event that several cupolas are used, they are rarely used at the same time but rather sequentially. On typical example of use is, further to a long period of inactivity, to have to carry out a rallying movement of the weapon system. A rallying movement consists in departing from the current or starting position of the system and moving it as quickly as possible to its new position of use. For this, the motorisation must allow a rotation of up to 180° of the cupola head of the weapon system. This rotation must be carried out at faster and faster speeds so as to match the constant evolution of the threats. The cupola then becomes inactive and another may be used to take over.

The profile of power consumed is very intermittent with a low demand on average but punctuated by peaks. The back-geared electric motor is not well adapted to such profiles of demand for power.

Hydraulic power, because of its storage possibilities, for example oil-hydraulic, is able to accommodate great fluctuation in the demand for power. However, in spite of its great specific output allowing a substantial power supply, the relatively large number of necessary components discourages the expert when he has to design a compact architecture compatible with the limited space in the equipment.

SUMMARY OF THE INVENTION

The present invention overcomes these drawbacks. To satisfy the high rate of power required to move a turret or a cupola, the present invention makes use of hydraulic power generation. This is made possible by a particular arrangement of the different components of the hydraulic generator.

The invention thus relates to an electro-hydraulic generator comprising a tank of hydraulic fluid and a set of components comprising a motor driving a hydraulic pump, an accumulator, means to distribute the hydraulic fluid and means linking the different components, wherein the tank and the components are inserted into a cylindrical volume delimited by a circular surface, a first plane end face and a second plane end face, and in that the components are fastened to the tank.

According to one characteristic, the tank is approximately cylindrical in shape delimited by a circular wall near to the circular surface, a first plane wall applied against the first plane face and a second plane wall.

The generator may incorporate an exchanger arranged according to the circular surface.

According to another characteristic, the generator incorporates a filter inserted in the cylindrical volume and fastened on the tank.

Advantageously, the components and the filter are fastened on the second plane wall and the pump is immersed in the tank.

According to yet another characteristic, the second plane wall incorporates, at right angles to at least one of the components or the filter, an axial setback and the motor is a direct current low voltage electric motor.

Advantageously, the filter is partly or fully inserted into the tank.

According to yet another characteristic, the tank has, at its circular wall, a radial setback intended to receive the accumulator.

The invention also relates to the application of the generator to the movement of at least one head assembly comprising an actuator driving a shaft, integral with a turret head, in rotation.

Advantageously, the actuator is a double-acting cylinder comprising a piston integral with a rack driven in translation, said rack meshing on a circular pinion integral with the shaft.

Advantageously again, the actuator is inserted in the cylindrical volume, arranged according to a diameter of said cylindrical volume and fastened on the plane wall of the tank and in that the head assembly is arranged above the cylindrical volume.

Advantageously again, at least one head assembly is offset at a distance from the generator.

Generally speaking, the electro-hydraulic generator is constructed, classically, with the following components: a motor driving a pump. This pump draws the hydraulic fluid in from a storage tank and compresses it in an accumulator. This accumulator, for example oil-hydraulic, well-known to the expert, allows the hydraulic power to be stored in the form of pressure, which may then be restored when the need arises. The hydraulic fluid is then controlled by distribution means. These distribution means, which may for example be a distributor or servo valve allow the use of the hydraulic power to be controlled by allowing or preventing the circulation of hydraulic fluid towards the consumer component.

This consumer component is, for example, an actuator having two chambers. The distribution means control any circulation of hydraulic fluid towards one or other of these chambers. The actuator produces a movement when stressed by the arrival of hydraulic fluid in its first chamber. A movement in the opposite direction is produced when the second chamber is stressed. The hydraulic fluid is then transported back to the tank. The different components through which it passes are connected together by linking means allowing the transportation of hydraulic fluid from one to another. These linking means comprise, for example, flexible or rigid piping elements, connectors, machined blocks, or any other means allowing the hydraulic fluid to be transferred. One advantageous construction of the electro-hydraulic generator according to the invention is to house the component assembly (motor, pump, accumulator, distribution means) and the tank in a first cylindrically-shaped volume that can be delimited by a case. Advantageously again, the components are all fastened to the tank.

Since the hydraulic generator produces a lot of heat through the throttling of the hydraulic fluid, it is advantageous to allocate it an exchanger to cool this fluid down. This exchanger is connect such that the fluid circulating in the hydraulic generator passes through the exchanger so as to be cooled. This is well known to the expert in hydraulic systems. In the invention, the exchanger is advantageously arranged in the arc of a circle along the circular surface of the tank. This allows it to be in contact with the exterior of the cupola and/or the carrying equipment.

One advantage of the device according to the present invention lies in the compactness of the electro-hydraulic generator. Its compactness, as well as making it easier to design equipment architectures, makes it possible to use hydraulic power in this type of application with all the advantages that are well-known to the expert.

Another advantage of the device according to the present invention is, when a compact generator is combined with a compact actuator it is possible to define a compact cupola, mainly in its vertical extension. When mounted on the top of a piece of equipment, either fixed or mobile, the whole of the cupola and, as the case may be, the associated hydraulic generator are mounted above the level of the equipment's roof. In the case of fixed equipment or military vehicles, this gives a decisive advantage because of the lesser prominence of the cupola above the equipment, thereby making its concealment all the easier and thus its protection with regard to any detection and/or threats all the better.

Another advantage of the device according to the present invention is, through the use of hydraulics, to have instantaneous power at the ready at a high rate but within a limited volume.

Another advantage of the device according to the present invention, linked to the use of hydraulics and accumulation means, is to be able to store power and thus be able to manage the great fluctuations in consumption whilst ensuring immediate availability.

Another advantage of the device according to the present invention is to allow the advantages of hydraulics to be combined with the taking of power from the available electric network on board the equipment or vehicle.

Another advantage of the device according to the present invention lies in its cylindrical shape which extends the volume occupied by the cupola head.

Another advantage of the device according to the present invention lies in the fastening of all the components on the tank. An easily handled single unit is thus obtained that can be installed into its housing in a single operation.

Another advantage of the device according to the present invention is to allow the use of a single hydraulic generator to supply several cupolas installed, for example, on the same fixed equipment or vehicle. This affords, in addition to the economic advantages, a substantial saving of space.

Another advantage of the device according to the present invention is to allow a close cupola head assembly to be installed directly above the generator and/or one or several cupola head assemblies offset at a distance.

Another advantage of the device according to the present invention obtained when a cupola head is offset is to substantially reduced the height of the cupola above the fixed equipment or vehicle with the advantages of reduced detectability that result from this.

Another advantage of the device according to the present invention lies in the use of linking means that may be flexible or rigid piping thereby offering the possibility of offsetting the hydraulic generator and allowing great architectural flexibility since the generator does not necessarily have to be housed under the head assembly.

BRIEF DESCRIPTION OF THE DRAWINGS

Other characteristics, particulars and advantages of the invention will become apparent from the detailed description given hereafter by way of illustration and with reference to the appended drawings, in which.

DETAILED DESCRIPTION FO PREFERRED EMBODIMENTS

Figure 1:
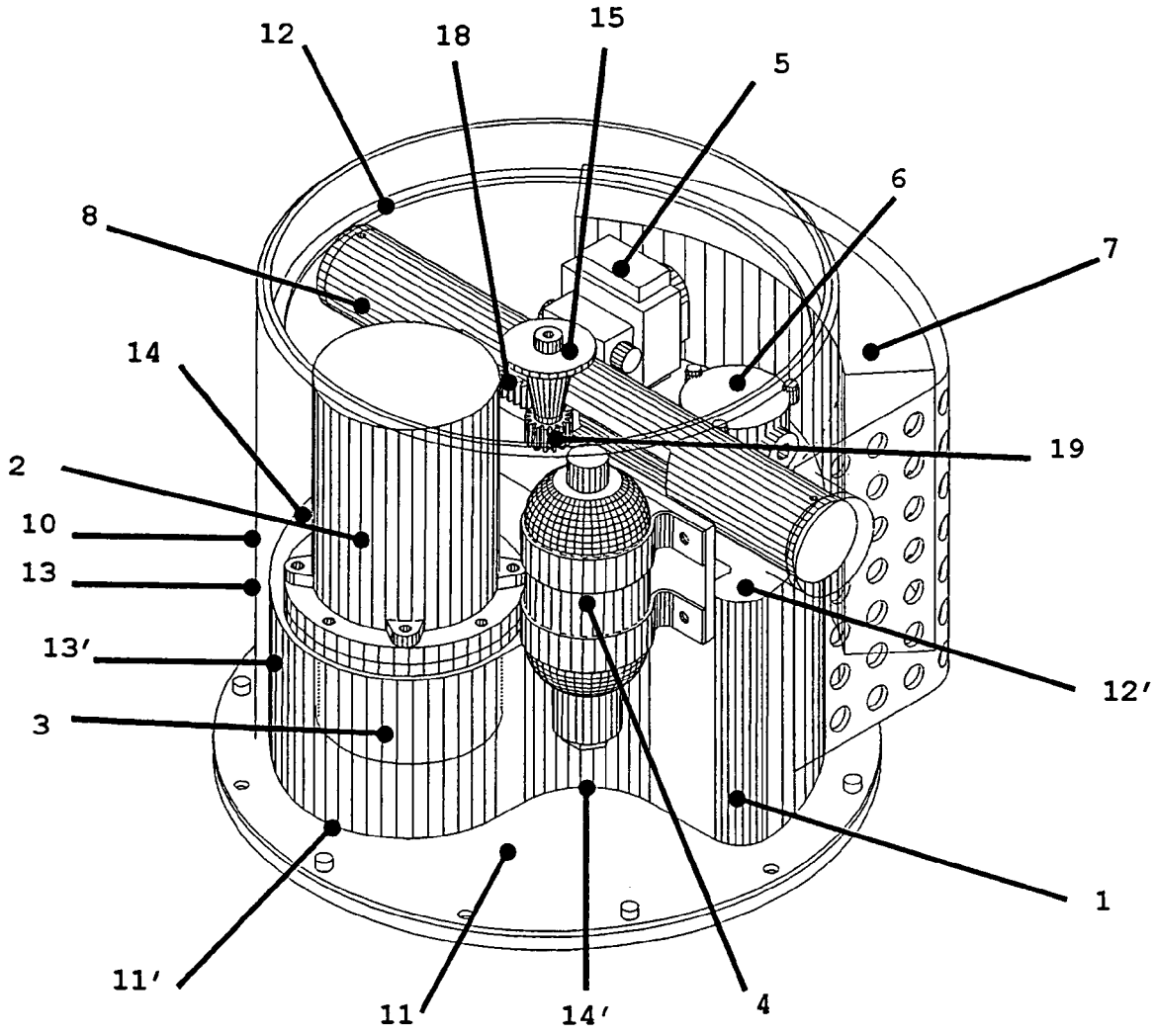
FIG. 1 shows a general perspective view of a preferred embodiment of the electro-hydraulic generator according to the present invention.

In FIG. 1, the electro-hydraulic generator comprises the following components: a tank or cistern of hydraulic fluid 1, a motor 2, a pump 3 housed inside the tank 1, facing the motor 2, an accumulator 4, distribution means 5, a filter 6, an exchanger 7, and actuator 8. The linking means 9 are not shown in the Figure. They are situated either outside or inside the tank 1 and connect components 2, 3, 4, 5, 6, 7, 8 and the tank 1 to form a circuit.

The hydraulic generator occupies a cylindrical volume 10. This first cylinder is delimited sidewards by a circular surface 13, downwards by a plane end surface 11 and upwards by a plane end surface 12.

In FIG. 1, the hydraulic generator is shown installed in a cylindrical case. The inside of the cylindrical case delimits this first cylinder 10, 11, 12, 13. In the configuration where the head assembly is shown close, this case ensures the protection of the hydraulic generator as well as the support of the cupola head assembly.

The tank 1 occupies a globally cylindrical volume. This cylinder is delimited sidewards by a circular wall 13', downwards by a plane end wall 11' and upwards by a plane end wall 12'.

The circular wall 13' takes the shape of the circular surface 13. It has a slightly smaller diameter. It covers the lower part.

The plane wall 11' rests on the plane surface 11 of which it takes the shape.

The cylindrical volume remaining in the cylindrical volume 10 and unoccupied by the tank 1 is used to house components 2, 3, 4, 5, 6, 7, 8, 9.

The motor 2, when there is an electric network, is advantageously an electric motor adapted to this network. In the case, for example, of an application on board a vehicle, where there is a low voltage direct current network.

This motor 2 drives a rotating hydraulic pump 3 in rotation. This pump 3 is advantageously immersed in the tank 1 of hydraulic fluid and, where the case may be, in the hydraulic fluid. The pump 3 is, for example, of the piston pump type or any other equivalent type, well known to the expert (vane pump, gear pump, etc). During its rotation, the pump 3 takes up hydraulic fluid from the tank 1 and sends it via the linking means 9 to the accumulator 4. This accumulator 4 allows hydraulic power to be stored in the form of pressure. Since hydraulic fluid can be incompressible, it is useful to have an accumulator 4 to store power. The accumulator may, for example, be of the oil-hydraulic type. In this type of accumulator 4, well known to the expert, a chamber containing a compressible fluid is separated from the hydraulic fluid by a deformable impermeable membrane. Under the action of the pump 3, the hydraulic fluid comes to press on the membrane, which deforms and compresses the compressible fluid, whose pressure increases. If the pressure in the hydraulic fluid is lowered, the compressible fluid expands and communicates its pressure to the hydraulic fluid. Any equivalent type of accumulator device may also be envisaged.

Such an accumulator device advantageously ensures, firstly a substantially power reserve that can be significantly greater than the mean power of the pump 2 and is immediately available, and secondly the absorption of the great fluctuations in power consumption, with a continuous production of the pump.

So as to be able to use this hydraulic power and control it, the hydraulic fluid is then directed to distribution means 5. These means, of the servo valve type, distributor or any other equivalent device, control the distribution of the hydraulic fluid to one or other of the consumers.

The hydraulic fluid has a tendency to heat up by compression and throttling in the different components 2, 3, 4, 5, 6, 7, 8 and linking means 9. This heating can present disadvantages and notably that of prejudicing the proper operation of the hydraulic generator. An exchanger 7 is advantageously positioned on the path of the hydraulic fluid enabling said fluid to be cooled. The principle of such an exchanger 7 is well known to the expert. It consists in presenting a large exchange surface between the hydraulic fluid and another colder environment. This exchanger 7 is advantageously placed, as seen in FIG. 1, on the circular periphery 13 of the cylinder 10.

Since the hydraulic fluid may become polluted during its passage by particles/impurities prejudicial to the proper operation of certain organs, it is advantageous to keep it constantly filtered. For this, a filter 6 is positioned generally so as to be the last component through which the hydraulic fluid passes during its circuit before returning into the tank 1. In order to save space, this filter 6 may be partly or fully inserted into the tank 1.

As seen in FIG. 1, all the components are fastened to the tank 1. Advantageously, in a preferred embodiment, all the components are fastened on the end wall 12'. Wall 11' of the tank is plane and constitutes one end of a cylindrically shaped volume. Wall 12' is substantially plane and constitutes the other end of said volume. It is arranged according to the heights of the different components that are fastened to it. Thus, for example, as seen in FIG. 1, the height of the distribution means 5 allow it to be positioned between the plane end wall 12' and the plane end surface 12. In this case, the wall 12' is modified by a localised setback 14 in its height. At this point, at right angles to the motor 2, the plane wall 12' is locally brought closer to plane wall 11' so as to allow the motor 2 to be housed.

The actuator 8 is shown in FIG. 1 in the form of a cylinder 8. FIG. 1 shows a close type assembly where the actuator 8 and the shaft 15 are fastened close to the hydraulic generator. In this case, the cylinder 8 is mounted on the tank 1, fastened to the wall 12'. It is housed in the volume delimited by the circular surface 13 and between the plane face 12 and the plane wall 12'. It is placed according to one diameter of the cylinder 10. The actuator 8 is a double-acting cylinder. It has two chambers in which the distribution means 5 may alternately send the hydraulic fluid. Between these two chambers there is a piston 18 moving in translation according to the axis of the actuator 8, respectively in one direction or the other under the effect or the pressure exerted respectively in one chamber or the other. This piston is integral with a rack 18. This rack 18 meshes on a pinion 19 integral with the shaft 15. The shaft is able to rotate around the axis of the cylinder 10. This shaft 15 is integral with a cupola head which it drives in rotation.

Figure 2:
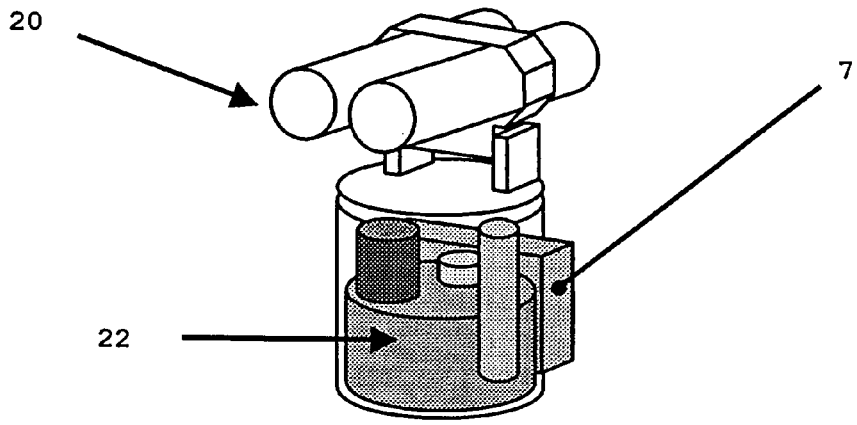
FIG. 2 shows a perspective view of a full cupola carrying, by way of illustration, a double barrelled weapon.

FIG. 2 shows a full cupola carrying, by way of illustration, a double-barrelled weapon. This cupola is constructed by assembling, in close configuration, a head assembly 20 comprising a cupola head 16, an actuator 8 (not shown) and a shaft 15 (not shown), on a hydraulic generator 22. The hydraulic generator is housed inside the cylindrical case of the cupola. Note that on the rear periphery of this case, there is a radially extending protuberance which corresponds to the housing for the exchanger 7. This Figure illustrates a configuration with a singe cupola constituted by a generator 22 and a close mounted head assembly 20.

Figure 3:
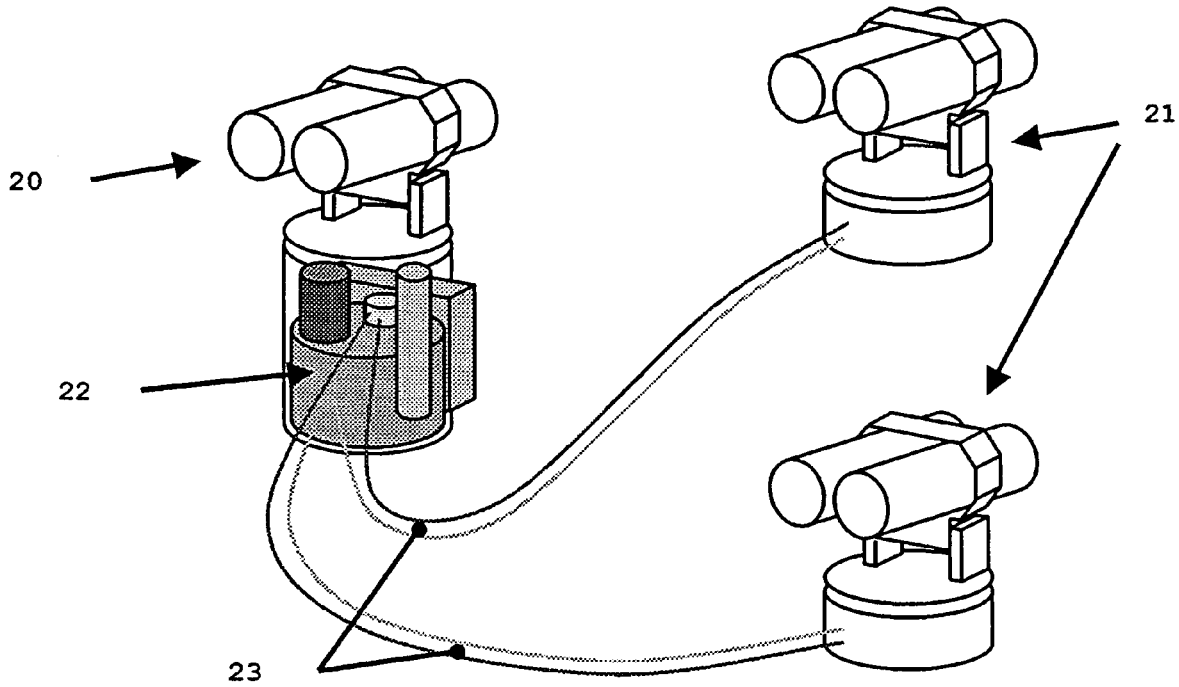
FIG. 3 illustrates a configuration with a close head assembly and two offset head assemblies.

FIG. 3 shows another configuration with a generator 22 supplying three head assemblies 20, 21, via linking means 23. The Figure shows, by way of illustration, a close head assembly 20 and two offset head assemblies 21.

Figure 4:
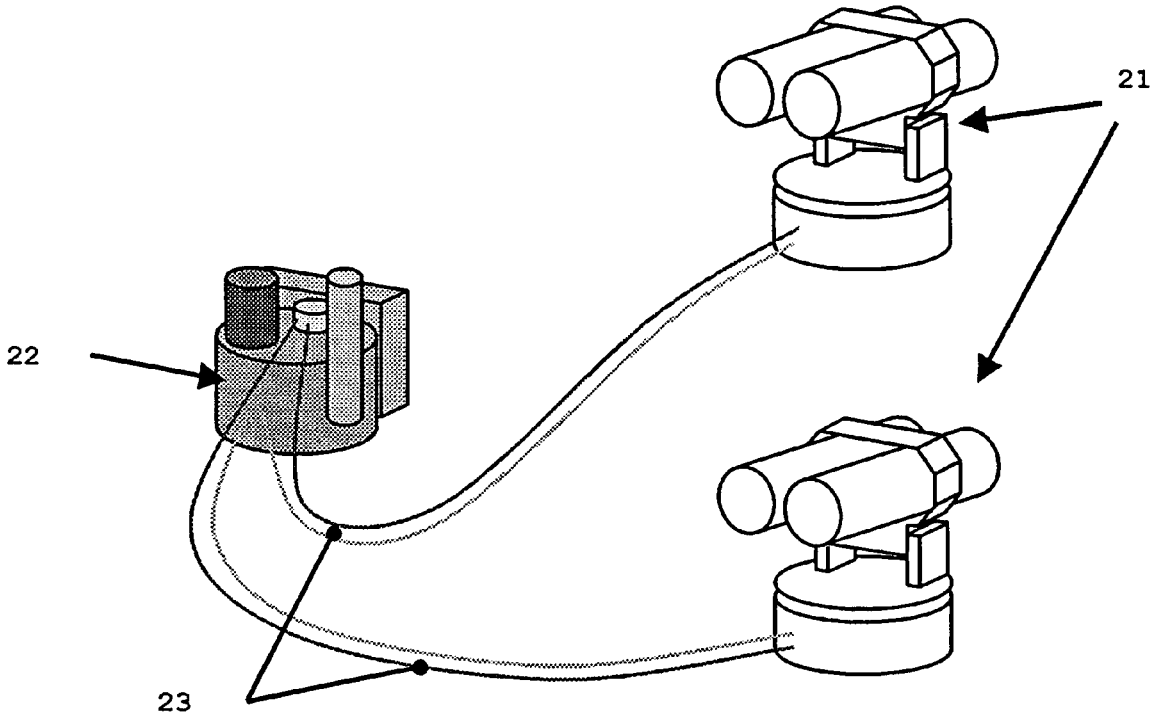
FIG. 4 shows a configuration with no close head assembly and with two offset head assemblies.

FIG. 4 shows another configuration with a generator 22 supplying two head assemblies 21, via linking means 23. It is not necessary to place a close head assembly 20 on the generator. The generator 22 may thus be more easily housed.

What is claimed is:

1. Electro-hydraulic generator comprising a tank of hydraulic fluid and a set of components comprising a motor driving a hydraulic pump, an accumulator, means to distribute the hydraulic fluid and means linking the components, wherein the tank and the components are inserted into a cylindrical volume delimited by a circular surface, said tank is approximately cylindrical in shape delimited by a circular wall near said circular surface, a first plane end face and a second plane end face, a first wall plane applied against said first plane face and a second plane wall, and the components are fastened to the tank.

2. Generator according to claim 1, wherein said generator incorporates an exchanger arranged according to said circular surface.

3. Generator according to claim 2, wherein said generator incorporates a filter inserted in said cylindrical volume and fastened on said tank.

4. Generator according to claim 3, wherein said components and said filter are fastened on said second plane wall.

5. Generator according to claim 3, wherein said filter is partly or fully inserted into said tank.

6. Generator according to claim 3, wherein said second plane wall incorporates an axial setback disposed at right angles to said filter.

7. Generator according to claim 1, wherein said pump is immersed in said tank.

8. Generator according to claim 1, wherein said second plane wall incorporates an axial setback disposed at right angles to at least one of said components.

9. Generator according to claim 1, wherein said motor is a direct current low voltage electric motor.

10. Generator according to claim 1, wherein said tank is provided at its circular wall with a radial setback intended to receive said accumulator.

11. Method to use said generator according to claim 1 comprising moving at least one head assembly comprising an actuator driving a shaft, integral with a turret head, in rotation.

12. Method according to claim 11, wherein said actuator is a double-acting cylinder comprising a piston integral with a rack driven in translation, said rack meshing on a circular pinion integral with said shaft.

13. Method according to claim 12, wherein said actuator is inserted in said cylindrical volume, arranged according to a diameter of said cylindrical volume and fastened on said plane wall of said tank and wherein said head assembly is arranged above said cylindrical volume.

14. Method according to claim 13, wherein at least one head assembly is offset at a distance from said generator.

* * * * *